United States Patent [19]

Harrold

[11] 4,320,035

[45] Mar. 16, 1982

[54] DIELECTRIC GAS-VAPOR AND VAPOR-VAPOR MIXTURES

[75] Inventor: Ronald T. Harrold, Murrysville, Pa.

[73] Assignee: Westinghouse Electric Corp., Pittsburgh, Pa.

[21] Appl. No.: 231,520

[22] Filed: Feb. 4, 1981

[51] Int. Cl.[3] ..... H01B 3/20

[52] U.S. Cl. ..... 252/574; 252/570; 252/571; 252/578; 252/580; 174/15 R; 174/17 GF

[58] Field of Search ..... 252/571, 574, 580, 578, 252/581, 570; 174/15 R, 17 GF

[56] References Cited

U.S. PATENT DOCUMENTS

| | | | |
|---|---|---|---|
| 2,221,670 | 11/1940 | Cooper | 174/17 GF |
| 2,853,540 | 9/1958 | Camilli et al. | 174/17 GF |
| 4,162,227 | 7/1979 | Cooke | 252/571 |

OTHER PUBLICATIONS

General Electric Review, vol. 40, No. 9, 1937, Charlton et al.

*Primary Examiner*—Mayer Weinblatt
*Attorney, Agent, or Firm*—L. P. Johns

[57] ABSTRACT

A dielectric fluid composition with high electrical strength characterized by a gas mixed with the vapor from a first fluid having a high vapor pressure at a low temperature and the vapor from a second fluid having a low vapor pressure at a low temperature to effect a mixture having a higher electrical strength than any component thereof over a temperature range from about −20° C. to −40° C. to about +120° C. to +140° C., with the vapor pressure of the mixture at the highest temperature being about one to two atmospheres. Also, the mixing of low and high cost liquids to obtain a low cost liquid with a vapor with an electrical strength equivalent or better than the best vapor over a wide temperature range.

1 Claim, 4 Drawing Figures

DIELECTRIC GAS-VAPOR AND VAPOR-VAPOR MIXTURES

GOVERNMENT CONTRACT

This invention was conceived during the performance of work under Contract RP-1499-2 for the Electric Power Research Institute.

CROSS-REFERENCE TO RELATED APPLICATIONS

This application is related to copending applications of Ronald T. Harrold, Ser. No. 163,902, filed June 27, 1980; and Ser. No. 163,901, filed June 27, 1980.

BACKGROUND OF THE INVENTION

1. Field of the Invention

This invention relates to dielectric gas-vapor and vapor-vapor compositions and, more particularly, it pertains to mixtures of a gas with the vapor from one fluid having a high vapor pressure at a low temperature and the vapor from another fluid having a low vapor pressure at a low temperature, with the objective of attaining high electrical strength over a temperature range from low temperature (~ −40° C.) to high temperature (~ +140° C.) with a vapor pressure not greater than one to two atmospheres at the highest temperature.

DESCRIPTION OF GASES AND VAPORS

The simple definition of a gas and a vapor at room temperature and atmospheric pressure is as follows:

Gas: A substance consisting of molecules in rapid and chaotic motion which completely fill a container.

Vapor: A gas completely filling the space above a liquid in a container and in equilibrium with the liquid, i.e., the number of molecules leaving the liquid in a given time is equal to the number of molecules returning. More precisely, a vapor is a gaseous substance with a temperature below the critical value, i.e., below the critical value a vapor can be condensed to a liquid by pressure alone.

2. Description of the Prior Art

Gases, vapors, and their mixtures have been used as electrical insulation for almost 100 years. In very early studies (K. Natterer, Annal. Phys. Chem. 88,663, 1889) it was demonstrated that vapors of carbon tetrachloride ($CCl_4$) can increase the dielectric strength of air at atmospheric pressure and room temperature. In 1937, Charlton and Cooper (General Electric Review, Vol. 40, No. 9, 1937) examined the electrical breakdown strengths of over 70 different gases and gas-vapor mixtures and clearly demonstrated that certain mixtures have high electrical strength. They documented the research carried out in this field up to 1937 and also distinguished between increased breakdown strengths due to corona stabilization (non-uniform fields), and increased breakdown strengths when corona does not occur before breakdown (uniform electrical fields).

In U.S. Pat. No. 2,221,670, 1937, by F. S. Cooper, the discovery of high electrical strength gaseous compounds containing chlorine and fluorine is reported. It is stated that preferably these should not be condensible and that most of the gases listed have a high electrical strength compared with nitrogen at the same pressure. As an example, the breakdown voltage of dichlorodifluoromethane ($CCl_2F_2$) at any substantial pressure is approximately 2½ times greater than the breakdown voltage in nitrogen at the same pressure. All the gaseous compounds reported show increased electrical strength when they are compressed.

U.S. Pat. No. 2,853,540, 1958, by G. Camilli et al., deals with the use of gas mixtures for high electrical strength, in particular for non-uniform fields where corona stabilization controls the breakdown. It is shown that for non-uniform fields, certain gas mixtures, such as nitrogen ($N_2$) and sulphur hexafluoride ($SF_6$), exhibit increasing electrical strength over an absolute pressure range from one to three atmospheres. Camilli also shows for the first time that for non-uniform fields, certain gas mixtures in about equal volume proportions, can have a higher electrical strength than either of the component gases at the same pressure and temperature.

In more recent work, U.S. Pat. No. 4,162,227, 1979, by C. Cooke, it is shown that the dielectric strength of mixtures of two or more gases can be higher than that of any of the individual gases at the same temperature and pressure, provided that the strength of one or more of the gases increases at less than a linear rate with increasing pressure. However, the breakdown experiments were carried out using non-uniform electrical fields, and the results seem similar to those reported in Camilli's earlier patent.

One problem in compressing a gas or gas mixtures to obtain high electrical strength is that a stronger and more expensive vessel is needed to contain the gas. Another consideration is the high cost of some of the gases, $SF_6$ for example, when large quantities are required. An important reason why gas mixtures are increasingly employed is because a high strength, high cost, dielectric gas may be mixed with a poorer one of lower cost to provide a mixture with an adequate dielectric strength.

As can be seen from the discussion of the prior art, gas or vapor mixtures are useful for saving cost and providing good dielectric strength at atmospheric pressure and above, for both uniform and non-uniform field conditions. However, at low temperatures, the vapors will be at low pressure, and consequently will have low electrical strength. This is not the case with gases, such as $SF_6$, which for a given pressure will exhibit little change in electrical strength over a temperature range of from about +100° C. to about −40° C. The electrical strength of vapors is important for vapor-cooled power transformers where the vapors of certain liquids must provide electrical insulation over an operating temperature range of from about +140° C. to about −40° C. At the highest temperature the vapor pressure should not be greater than about one to two atmospheres, otherwise a high pressure containment vessel will be needed; and at the lowest temperatures, the electrical strength of the vapor must be adequate. However, if the vapor is electrically strong at low temperatures, then the vapor pressure would have to be high, and consequently at high temperatures, the vapor pressure would be excessively high (several atmospheres).

It is an object of this invention to provide a mixture of vapors and a gas which will give a substantially uniform electrical strength over a temperature range of from about +140° C. to about −40° C. Another object of this invention is to provide a mixture of vapors and a gas which has a vapor pressure of not more than about one to two atmospheres in the approximate +120° C. to +140° C. temperature range.

SUMMARY OF THE INVENTION

In accordance with this invention, a dielectric fluid composition is provided which comprises a mixture of the vapor from two fluids with a gas; one fluid having a high vapor pressure at a temperature range of from about −20° C. to about −40° C.; the other fluid having a low vapor pressure at said temperature range, whereby the resulting vapor/vapor/gas mixture has a higher electrical strength than any component thereof at the same temperature. The dielectric fluid composition has substantially uniform dielectric effect over a temperature range of from about −40° C. to about 140° C., and has a vapor pressure of from about 1 to 2 atmospheres at the highest temperature.

Another important feature of this invention is the mixing of two liquids, one of which is of high cost and has a vapor with a high electrical strength. The other liquid may be of low cost and have a vapor with a moderate electrical strength. The liquids may be mixed in certain proportions so that a low cost liquid results with a vapor electrical strength equivalent or better than the best vapor over a wide temperature range.

The advantage of the dielectric fluid composition of this invention is that gas vapor and vapor-vapor mixtures can have higher electrical strength than their separate components at the same temperature. Specific applications may be in vapor-cooled power transformers, where low and high cost liquids can be mixed to obtain vapor mixtures of high electrical strength, especially at low temperatures.

DESCRIPTION OF PREFERRED EMBODIMENTS

Figure 1:
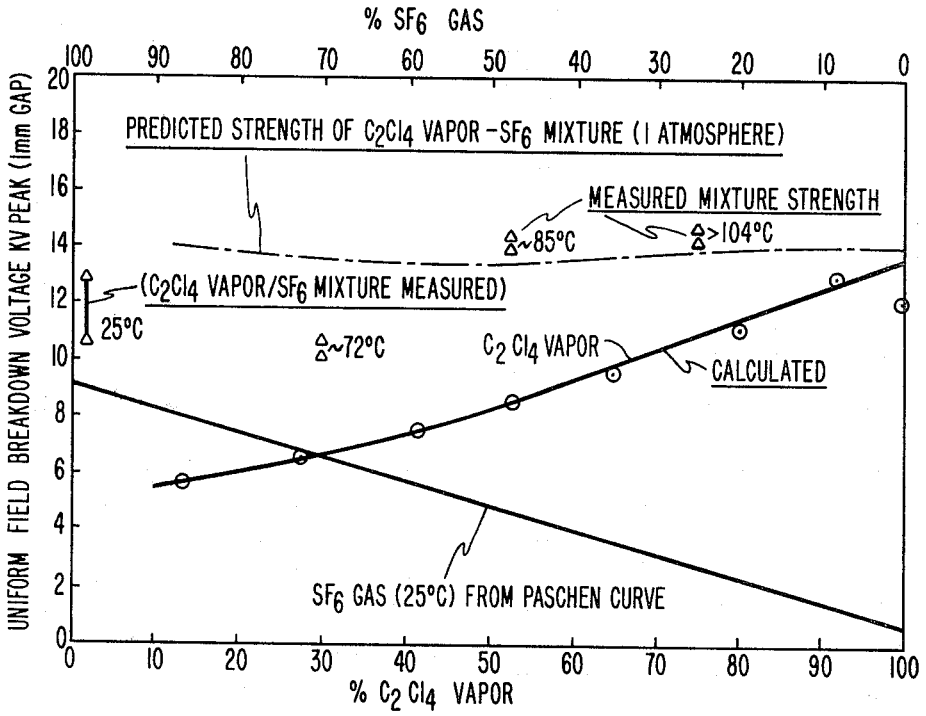
FIG. 1 is a graph showing the electrical breakdown voltages of $SF_6$, $C_2Cl_4$ vapor, and mixtures of $SF_6/C_2Cl_4$ vapor, expressed in percentages of $SF_6$ gas and $C_2Cl_4$ vapor, where 100% represents one atmosphere pressure.

In FIG. 1, the breakdown voltages for $C_2Cl_4$ vapor alone and $SF_6$ gas alone are plotted in opposite directions against pressure ranging from zero to one atmosphere. The pressure is expressed in percent or percent of molecules of gas, or vapor from 0 to 100% (where 100% represents one atmosphere pressure). The breakdown voltage of any mixture is obtained by simple addition of the breakdown voltages of $C_2C_4$ vapor and $SF_6$ gas at the partial pressures which add to one atmosphere. As an example, 75% $C_2Cl_4$ vapor plus 25% $SF_6$ gas gives 100% pressure, or one atmosphere, and the respective breakdown voltages are ~10.7 kVpk and 2.6 kVpk, which gives a mixture strength of 10.7+2.6 kVpk=13.3 kVpk. The breakdown strengths of any other mixture combination can be predicted in a similar way, and it can be seen that the mixture strength is always about equal to, or 5 to 10% greater than, the strength of 100% $C_2Cl_4$ vapor (the strongest dielectric at one atmosphere pressure). It had been anticipated that any mixture combination of $SF_6$ gas and $C_2Cl_4$ vapor which gives one atmosphere pressure would have a dielectric strength equal to or greater than that of $C_2Cl_4$ vapor at one atmosphere. The breakdown mixtures from experimental data (FIG. 1) confirm the accuracy of this expectation, except for one value at ~30% $C_2Cl_4$ vapor plus ~70% $SF_6$, where the breakdown strength appears to be only 70% as strong as that of 100% $C_2Cl_4$ vapor. It should be noted that the breakdown strength of $C_2Cl_4$ vapor varies considerably with temperature (FIGS. 2 and 3), because of the change in vapor pressure, but that the pressure of the $SF_6$ gas only varies slightly with temperature.

As an example (FIG. 2), the vapor pressure of $C_2Cl_4$ increases from 18 Torr at 25° C. to 760 Torr (1 atm) at 120° C.; but from the gas laws, $SF_6$ gas would increase in pressure only about 30% over the same temperature range. An advantage of $SF_6/C_2Cl_4$ vapor mixtures is the large increase in dielectric strength which can be achieved at the same temperature (FIGS. 1, 2 and 3) at 95° C., the vapor pressure of $C_2Cl_4$ is ~380 Torr, and the breakdown strength is 8 kVpk, while the $SF_6$ strength at 380 Torr is ~5 kVpk; but at only 85° C. the 50/50 mixture of $SF_6$ and $C_2Cl_4$ vapor at 760 Torr has a breakdown strength of ~14 kVpk.

As this investigation has demonstrated the high electrical strength which can be achieved with gas-vapor mixtures, it was thought worthwhile to examine vapor-vapor mixtures. Although it was realized that the mixing rules would be different for vapor-vapor mixtures because of the different vapor/pressure characteristics, a vapor mixture with a higher electrical strength than the individual vapors would be important for vapor-cooled transformers. Vapor mixtures with high electrical strength would open up the possibility of mixing low cost and high cost liquid dielectrics to obtain the vapor mix, and the vapors could have higher electrical strength on cold start-up of a vapor-cooled power transformer.

Liquid mixtures of $C_2Cl_4$ and the fluorocarbon Rimar R101 ($C_8F_{16}O$) were heated to give different vapor mixtures. The predicted and measured breakdown strengths of the vapor mixtures are in substantial agreement.

In order to predict the electrical breakdown strength of vapor-vapor mixtures, data on the vapor pressure characteristics of the liquids used are required and vapor pressure curves (FIG. 2) are illustrated for tetrachloroethylene ($C_2Cl_4$), Rimar R101 ($C_8F_{16}O$) (Perfluorodibutyl ether), methylene chloride ($CH_2Cl_2$), and for a mixture of 180 Torr $SF_6$ gas with the vapors from a by volume mixture of 30% $CH_2Cl_2$ and 70% $C_2Cl_4$. The breakdown voltage curves for $C_2Cl_4$ vapor alone and Rimar R101 vapor alone, over the 100 to 730 Torr pressure range, are shown in FIG. 3. At one atmosphere pressure, Rimar R101 is ~40% stronger than $C_2Cl_4$, but at pressures below ~350 Torr the breakdown strengths of the vapors are similar.

Vapors which do not react chemically should mix according to Raoult's Law, which states that the partial pressure of any component is equal to its vapor pressure in the pure state multiplied by its mol fraction in the solution, i.e., $p_1 = P_1 X_1$, where $p_1$ is the partial vapor pressure of a component of a mixture, $P_1$ is the vapor pressure of the pure component at the temperature of the mixture, and $X_1$ is the mol fraction of the component in the mixture.

To predict the electrical strength of the vapor mixtures at 100° C. from a liquid mixture (by volume) of 50% $C_2Cl_4$ and 50% Rimar 101, proceed as follows:

From the vapor pressure curve (FIG. 2) at 100° C., the vapor pressure of $C_2Cl_4$ is ~400 Torr, and the vapor pressure of Rimar R101 is ~800 Torr. Using Raoult's Law, the partial pressure from these components become ~70/100×400 Torr=280 Torr, and ~30/100×800 Torr=240 Torr, respectively, or the mixture pressure is 280+240 Torr=520 Torr. Referring to the breakdown voltage curve (FIG. 3), the breakdown strength for $C_2Cl_4$ at 280 Torr is ~7.5 kVpk and the breakdown strength for Rimar 101 at 240 Torr is ~7 kVpk. Therefore, the predicted combined breakdown strength of the vapor-vapor mixture at 100° C. and 520 Torr pressure is 7.5+7.0 kVpk=14.5 kVpk. This is 45% higher than $C_2Cl_4$ vapor alone and ~11% higher than Rimar R101 vapor alone at the same pressure of 520 Torr (FIG. 3). The measured breakdown strength of this vapor mixture is 13.5 kVpk which is close to the 14.5 kVpk predicted (FIG. 3). The breakdown strengths of the mixture at different temperatures can be predicted in a similar way.

In FIG. 3, the breakdown strengths of vapor-vapor mixtures of $C_2Cl_4$ and Rimar 101 are illustrated over the ~100 Torr to 730 Torr pressure range, for heated liquid mixtures of 50% $C_2Cl_4$ and 50% Rimar R101; and 90% $C_2Cl_4$ and 10% Rimar R101, all by volume. It can be seen that at any pressure the vapor-vapor mixtures are as electrically strong as Rimar R101, the strongest vapor, and in the pressure range ~200 to ~600 Torr are stronger than Rimar R101 vapor.

Apparently, there are numerous combinations of vapor-vapor mixtures from different liquids that can be used to economically improve the electrical breakdown characteristics of vapor-cooled power transformers. Nontoxic fluorocarbon dielectric liquids are available, i.e., $C_8F_{16}O$, and many of the dielectric fluids used in the past could probably be used.

Fluids having high vapor pressure are methylene chloride ($CH_2Cl_2$), trichlorofluoromethane ($CCl_3F$) [Freons 14 to 12], and the fluorocarbon liquids known as "Fluorinert" FC-72, FC-78, FC-88.

Fluids having lower vapor pressure are tetrachloroethylene ($C_2Cl_4$), perfluorodibutylether ($C_8F_{16}O$), and the Fluorinert liquids, FC-40, FC-43, FC-48, FC-70, and Freons 112, 113.

Though $SF_6$ gas is disclosed it is understood that other dielectric gases, such as $N_2$, $CO_2$, and He, are suitable either as complete or partial substitutes therefor.

Figure 2:
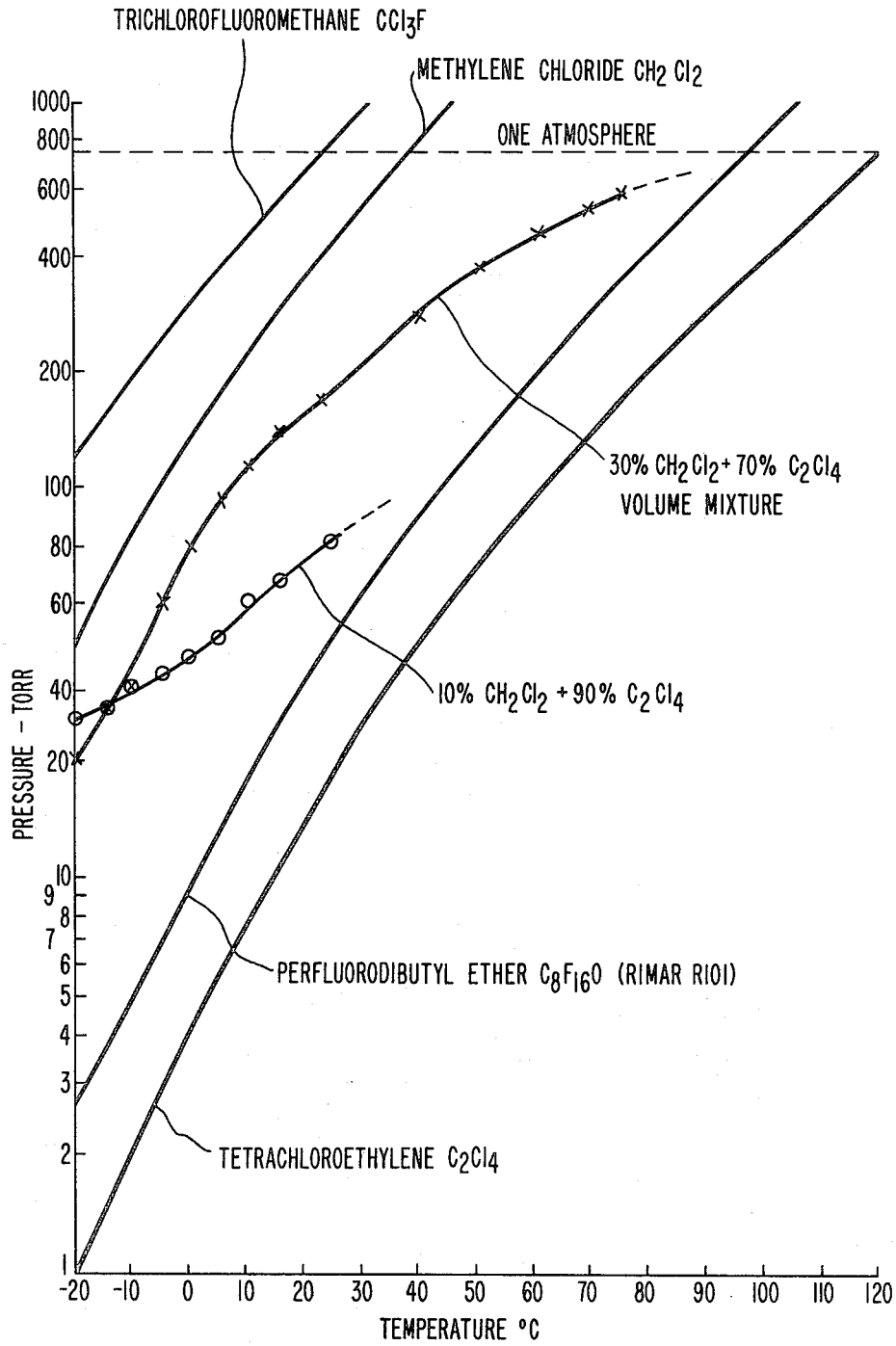
FIG. 2 is a graph showing vapor pressure curves for several vapors and vapor mixtures.
Figure 3:
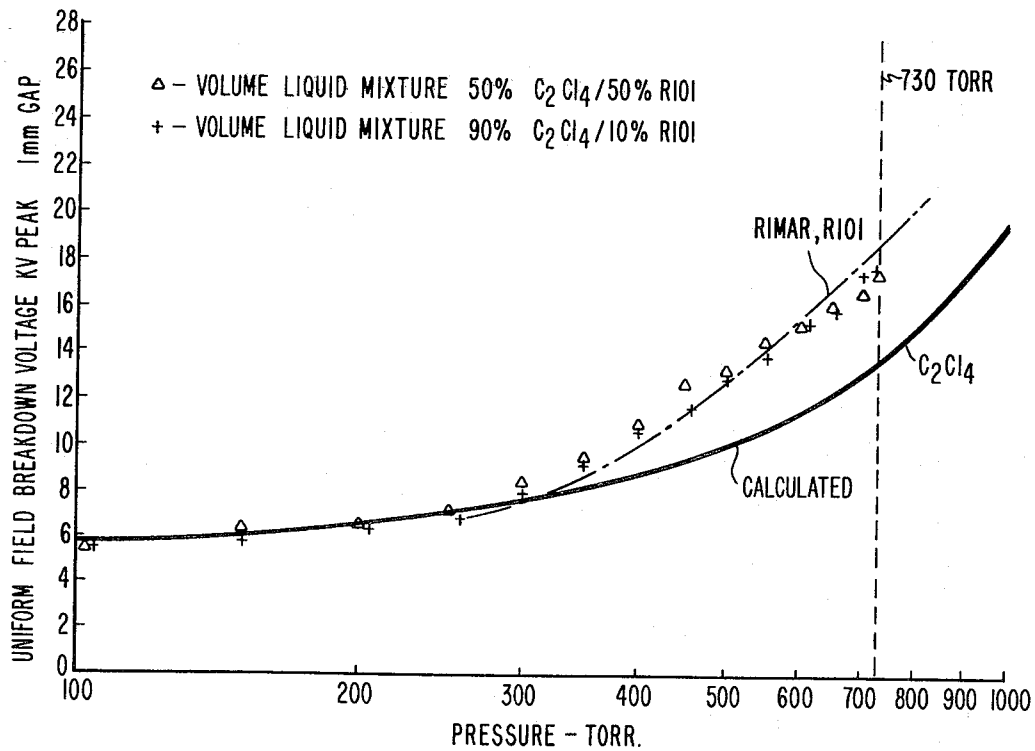
FIG. 3 is a graph showing uniform field breakdown voltages of $C_2Cl_4$ vapor, $C_8F_{16}O$ (RIMAR R101) vapor, and vapor-vapor mixtures over a pressure range.
Figure 4:
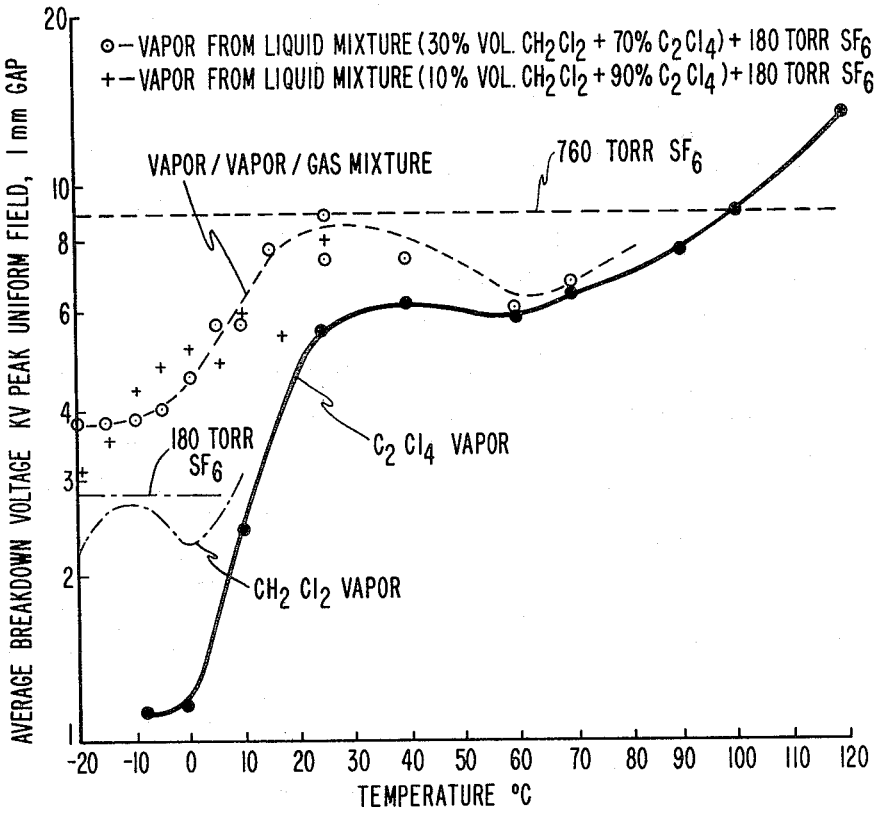
FIG. 4 is a graph showing uniform field breakdown voltages for $C_2Cl_4$ vapor, $CH_2Cl_2$ vapor, $SF_6$ gas, and vapor/vapor/gas mixtures over a temperature range.

Moreover, as shown in FIG. 2, a low vapor pressure liquid is one having a vapor pressure of below 10 Torr at −20° C. and a vapor pressure of about 1 atmosphere (760 Torr) at 120° C. Conversely, a high vapor pressure liquid has a vapor pressure of greater than 10 Torr at −20° C. and a vapor pressure of several atmospheres at 120° C.

In summary, gas-vapor mixtures have important applications when an increase in a gas or vapor electrical strength is required, or when it is desired that a vapor has a higher electrical strength at lower temperatures. Also, the electrical strengths of gases can be increased substantially with the addition of small quantities of dielectric vapors. Where vapor-vapor mixtures are concerned, it is possible to mix a small quantity of high cost liquid with a low cost liquid and obtain a vapor mixture with an electrical strength as high or higher than the strongest vapor over a wide temperature range. Vapor-vapor mixtures appear well suited for application to vapor-cooled power transformers and it is likely that two or more liquids could be mixed in appropriate proportions so that the resulting vapor has a high electrical strength at low temperature.

What is claimed is:

1. A dielectric fluid composition consisting of a gas-vapor mixture of $SF_6$ gas at 180 Torr, and a vapor mix of from about 10% to 30% $CH_2Cl_4$ and of from about 70% to 90% $C_2Cl_4$, both by volume.

* * * * *